United States Patent [19]

Marcinkiewicz

[11] 4,085,677

[45] Apr. 25, 1978

[54] HAND LOADED SHOT SHELL

[76] Inventor: Michael John Marcinkiewicz, 13 Madison St., Chicopee, Mass. 01020

[21] Appl. No.: 735,421

[22] Filed: Oct. 26, 1976

[51] Int. Cl.[2] ..... F42B 7/04

[52] U.S. Cl. ..... 102/42 R; 102/43 C; 102/95

[58] Field of Search ..... 102/42 R, 42 C, 43 R, 102/43 C, 95

[56] References Cited

U.S. PATENT DOCUMENTS 2,919,647 1/1960 Dear et al. ..... 102/42 R

FOREIGN PATENT DOCUMENTS 1,474,070 2/1967 France ..... 102/42 C 2,983 of 1905 United Kingdom ..... 102/42 C

*Primary Examiner*—Verlin R. Pendegrass

*Attorney, Agent, or Firm*—Ross, Ross & Flavin

[57] ABSTRACT

A shot shell having the characteristic of allowing a leakage of the ignited powder charge to vent around or through the shot charge for achieving preliminary blow off of the nose cap forwardly of the shot charge prior to the propulsion of the shot charge resulting from the main thrust of the expanding gases.

8 Claims, 5 Drawing Figures

HAND LOADED SHOT SHELL

The invention is directed to a shot shell construction which includes a case having an interior side wall tapering from the case base to the case mouth, a primer in the case base, a powder charge disposed in the case base, a shot charge, a nose cap held relative to the case, and an obturating or non-obturating type wad which allows a leakage of the ignited powder charge to vent around or through the shot charge for achieving preliminary blow off of the nose cap forwardly of the shot charge prior to the propulsion of the shot charge resulting from the main thrust of the expanding gases.

With the wad (full sized if of non-obturating type; undersized if of obturating type) seated over the powder charge, powder ignition causes an initial rapid pressure buildup accompanied by a unitary movement of wad, shot charge, sleeve if used, and hard nosed cap and a gradual progressive release of the generated gas around the wad periphery and forwardly of the shot charge and interiorly of the nose cap in order to effect nose cap blow off during shot charge propulsion, all within the interval where the square area of the annular space between wad periphery and inner case wall increase accordingly as the wad is motivated forwardly so as to accelerate the gas escape.

The rapid initial build up of pressure, so desirable in the case of modern smokeless powder to allow attainment of a proper combustion rate with reliability and consistency, unlike black powder (which needs no confinement), is followed by a gradual progressive release of the gas. In this way is served in seriatim the purpose of first propelling the nose cap and the purpose of second propelling the shot charge.

The invention hereof comprehends arrangements both with and without the use of a sleeve, the use being preferred though not necessarily imperative. The sleeve prevents barrel leading and direct contact between hot gases and shot, the sleeve serving as a curtain therebetween. By the use of longer sleeves and/or sleeves of other thicknesses or other friction coefficients and/or by the use of different wrap methods than are herein exemplified, it is possible to influence the degree of pattern spread desired from the muzzle to a distance of approximately 25 feet.

When the sleeve is used, it augments the control of any excessive power loss by virtue of its capacity for forcing itself in a distending manner against the inner case wall and in turn against the barrel bore wall as the result of a fluidlike reaction of the shot responsively to the accelerating force of the gases so as to achieve side wall sealing.

The sleeve is particularly desirable in cases where larger shot sizes are employed in that, were a sleeve not used, the larger shot sizes would not offer as many circuitous routes for the gas so as to retard and help to seal off excessive gas loss.

Shot shell cartridges for use in handguns are admittedly old in the art, being most commonly known and successful in connection with use in revolvers wherewith a plurality of quick successive shots could be fired. Of course, in such instance, the multiplicity of chambers could each be manually loaded prior to firing.

But problems are inherent in semi-automatic, short recoil, magazine-fed pistols where each cartridge has to be in seriatim stripped from its magazine, fed along a feed ramp, and chambered prior to discharge.

The inherent problems have dictated, until now, that the commercially-produced shot shells for pistols of such as the well known 1911A1 type be of the single shot gender.

The invention herein described is adapted to apply to any straight-walled rifle, revolver or automatic pistol case but for purposes of exemplification, a showing is made of a shot shell for specific use in an automatic pistol.

Primary advantages of the shot shell hereof reside in its function much as the common standard ball round insofar as reliability is concerned, its increased shot capacity and its allowed use of a tough, durable hard nose cap, which shot shell permits a charging of a magazine as in the normal charging manner, with a plurality of such being successively fired.

Appearancewise, it is difficult to distinguish between the standard ball round and the shot shell hereof, the copper jacketed bullet cap shape of the one closely resembling that of the other. In point of fact, the shot shell may be loaded in the standard auto pistol magazine and conventionally fired in the manner of a short recoil pistol without modification of either pistol or magazine.

Present commercially-available shot shell cartridges see the use of disintegratible plastic or synthetic caps, neither of which are, or are designed to be, sufficiently strong enough to survive with any degree of consistency the violent short recoil feed cycle of the automatic pistol.

Survival of that violence is best made possible by the use of the hard nose cap, herein described, of dimensions and configuration such as to ensure reliable and easy magazine load and chamber feed, and with a capacity for resisting any deformation upon striking the feed ramp and for precluding any misalignment with, or worse, dislodgement from, the case.

The results in firing shot contained by any copper-jacketed hard nose cap having an adequate lateral skirt for enclosing the shot in order to prevent misalignment or dislodgement can be disappointing, it being recognized that the nose cap normally moves downwardly of the barrel simultaneously with the shot and, in the process, encloses or entraps a large portion thereof, all with the obvious resultant effect of precluding shot dispersal into a desired pattern.

To the end of solving this problem, I have developed a method for aiding nose cap release so as to accelerate its down barrel movement forwardly of and ahead of the shot to assure subsequent shot dispersal unhampered by the nose cap.

Other features and advantages will hereinafter appear.

In the drawing accompanying this specification, similar characters of reference are used to designate like components throughout the several views, namely:

FIG. 1 which is an axial view, in section, of a preferred form of shot shell embodying the spirit of the invention;

Figure 1:
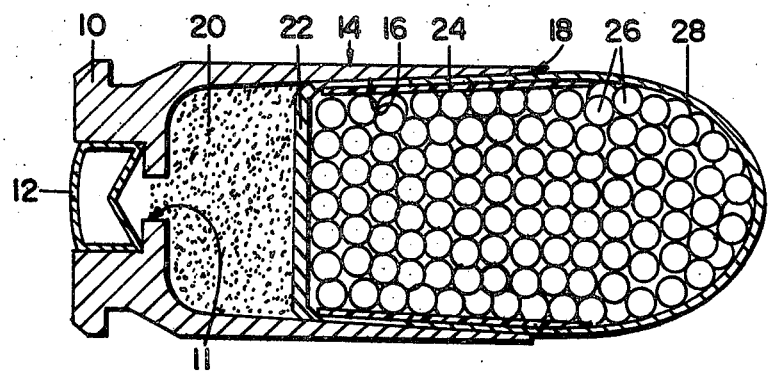

A standard cal. .45 ACP cartridge case 10 is primed with a standard large pistol primer 12, the side wall of the case having an exterior straight wall 14 and an interior tapered wall 16 thereby defining a relatively thick cross section of side wall adjacent the base and a relatively thin cross section of side wall at the case mouth 18.

Into the case interior, a charge of a pistol powder 20 is introduced.

An overpowder wad 22 is preferentially cut from a paper, such as a hard oak pattern paper, so as to offer a diameter substantially equal to the case I.D. at its mouth 18, such wad being seated over the powder charge by suitable instrumentation to offer to the wad a forwardly-facing peripheral lip 23 in tight embracement with the case wall.

A sleeve 24, preferentially formed from a plastic sheet as sourced by Clopay Corp. under the identification symbol W4000-149, is of 11/1000 inches thickness, 1½ inch length, and ¾ inch width, and of 5 grain weight. It is provided with a plurality of equispaced slits or cuts 25, about ⅜ inch apart, extending inwardly from the forward edge 27 thereof for a distance of ¼ inch. The sheet is wrapped into a cylindrical, sleeve-defining shape, care being taken to exploit the twist of the rifling in the pistol barrel in order best to retard any wrap opening during operational use.

Sleeve 24 is inserted into the case so as to bottom against wad 22 and thus provide an interior well into which a shot charge 26 may be introduced.

For purposes of exemplification, 170 grains of #9 shot, may be charged into the well, such a charge coming approximately to the level as defined by the slitted forward edge 27 of the sleeve.

A suitable hard nose cap 28, adequate for surviving the magazine-to-chamber feed cycle, is brought over the forward free edge of sleeve 24, some overlap of the sections thereof between the slits being allowed thus to permit a more easy introduction of the nose cap over the sleeve and into the case mouth to the proper distance so as to define a shell having a desired overall lengthwise dimension. Thereupon, the case is lightly crimped so as firmly to embrace the nose cap.

Figure 2:
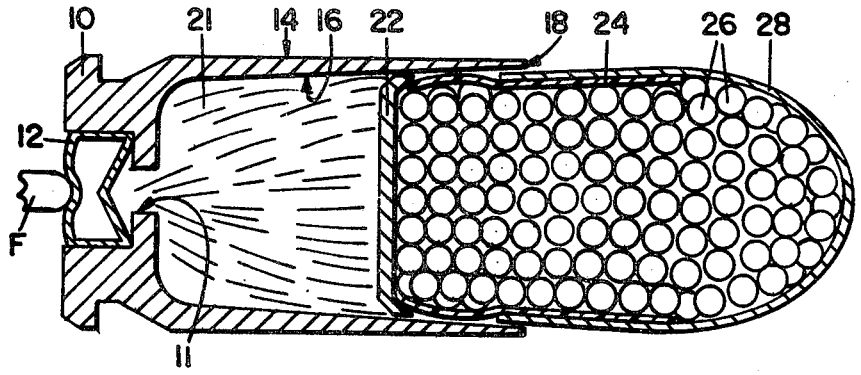
FIG. 2 is an axial view, in section, of the FIG. 1 shot shell immediately following primer detonation.
Figure 3:
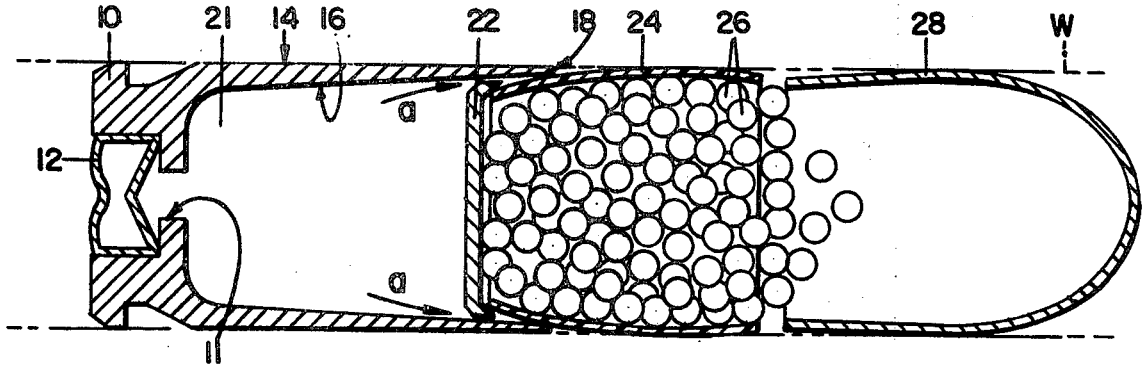
FIG. 3 is a sectional view of the fired shot shell as the nose cap proceeds down barrel.
Figure 4:
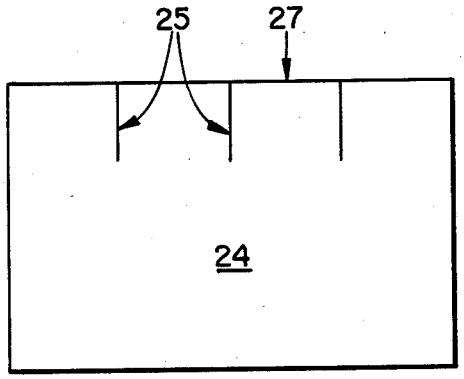
FIG. 4 is a top plan view of the sleeve before rolling of same into the cylindrical sleeve-defining shape.

The theory of the functioning of the shot shell is described with special reference to FIGS. 2 and 3.

With the pistol firing pin F driven into operational position, the pellets of the priming mixture are detonated and the incendiary particles travel through the flash hole 11 to ignite powder charge 20 which, in turn, converts from a solid mass to a gas 21 of increasingly larger volume.

The expanding of gas 21 initiates a slight initial unitary movement of the over powder wad, shot charge, sleeve and nose cap, the combined weight of those components offering a resistance to the smokeless powder charge sufficient for same to achieve its proper progressive burning rate.

As shown in FIG. 2, the nose cap, shot charge, sleeve and over powder wad have each moved through a distance such as to allow time for a reliable ignition of the powder charge before the generated gas commences to flow circumadjacent the wad periphery 23 as indicated by arrows *a*.

The flowing gas continues onward and outward circumadjacent the column of shot within and protected by such sleeve and toward the dome interior of the nose cap, collecting thereunder until a sufficiency has developed as to expel it from the barrel forwardly of the shot charge.

Subsequently in point of time, the shot charge is allowed to disperse normally and free of any enclosure and entrapment within the nose cap.

The sleeve protects the shot from the hot powder gases generated in firing, functioning as a curtain therebetween, and as well precludes leading by minimizing the contact of the shot with the rifling of the barrel bore W. The sleeve slits help to prevent the shot from becoming lodged within the nose cap and further help to prevent the nose cap from stripping and carrying off the sleeve by converting potential pressure folds within the nose cap into folds. The reduction of pressure folds when using a conical shaped nose cap also prevents dislodgement of the nose cap by internal pressure caused by compression of an unslit wrap (instead of allowing a slit wrap to fold without creating pressure folds).

The sleeve performs a second and valuable service in that it controls and prevents an excessive loss of powder gas. This is resultant from the fluidlike reaction of the shot charge against the sleeve so as to force the sleeve into a bearing relationship against the side of the case and subsequently against the barrel bore, so as effectively to minimize peripheral bleed off or venting without any undue velocity loss necessary for the secondary purpose of propelling the shot charge.

When a sleeve is not used, particularly in conjunction with smaller shot sizes (such as #12, #9, #8, #7½), the efficiency loss is not always overly excessive due to the fact that these smaller shot sizes offer more circuitous routes along which the gas can travel en route to the nose cap. When larger shot sizes are employed, the spaces between the shot being dimensionally greater allow a larger volume of gas to escape.

When a sleeve is not used, the shot capacity is increased by approximately 25%. In such cases, when maximum shot weight is desired, it is recommended that plated shot be used in conjunction with a polished and hard chrome-plated barrel to reduce leading.

Figure 5:
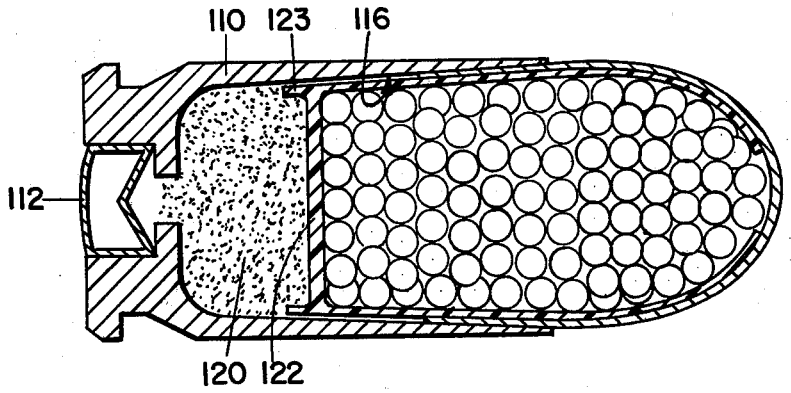
FIG. 5 is an axial view, in section, of a modified form of shot shell embodying a wad of obturating type.

It is the fluid effect of shot when used with the sleeve which makes it possible for an undersized obturating wad or a properly dimensioned non-obturating wad to provide power to function a recoil operated pistol with increased success as will appear in connection with the showing of FIG. 5.

The key to the invention is in the allowance of a flow of a portion of the gas circumadjacent the wad toward and into the nose cap for the blowing of same clear of the shot charge, thereby allowing the use of a hollow, hard, non-disintegrating nose cap suitable for use in short recoil-operated pistols and carbines and rifles, and revolvers with straight cases, all previously considered impractical prior hereto.

In FIG. 5, a showing is made of a modified form of shot shell embodying a wad of obturating type.

Case 110, primed with primer 112 and provided with tapered interior side wall 116, is charged with powder 120 over which a unitary sleeved obturating wad 122 is seated, same having an undersized depending skirt 123 with a capacity for obturating under the pressure of the expanding gas for a short distance in its travel along and relative to the case side wall.

As the wad moves relative to the tapered case wall, there is a bleed off caused by a failure of the skirt, being undersized, to completely seal off the gas escape.

By way of exemplification, a Remington SP410 obturating wad was used, the wad being an undersized 0.397 inch instead of the usual 0.452 inch. The shot comprised 120 grains of #9 shot, a copper hard nose cap was used and the sleeve was ¾ inch in height. While the recoil experienced was milder, enough pressure was yet available to function the weapon reliably even with the reduced shot weight. Side wall sealing achieved by the fluid effect of the shot acting upon such sleeve material made it possible, though not desirable, to use such obviously inefficient over powder wads.

I claim:

1. A shotshell comprising: a tubular case having a cylindrical sidewall and a base and a mouth at its opposite ends and with the I.D. of the sidewall increasing progressively from base to mouth, the base having a primer pocket and a flash-hole leading through the base from the primer pocket, a primer in the primer pocket, a powder charge in the case forwardly of the base, means comprising a non-obturating type wad for allowing a gradual progressive release of the gas around the wad periphery and into the progressively increasing annular space between wad periphery and sidewall I.D. and interiorly of the nose cap for achieving nose cap blow off in advance of shot charge propulsion, said means comprising a non-obturating type wad seated in the case forwardly of the powder charge with a peripheral edge in embracement with the sidewall I.D., a shot charge forwardly of the wad, and a nose cap forwardly of the shot charge and seated within the case mouth.

2. The shotshell as set forth in claim 1, and including a cylindrical sleeve seated in the case forwardly of the wad and in embracement with the sidewall I.D. and having a forward extremity extending forwardly of the case mouth, with the nose cap encapsulating the outer forward end of the sleeve.

3. The shotshell as set forth in claim 2, with the sleeve having rearwardly extending slits from the forward end thereof.

4. The shotshell as set forth in claim 2, with the wad and sleeve being unitary.

5. A shotshell comprising: a tubular case having a cylindrical sidewall and a base and a mouth at its opposite ends and with the I.D. of the sidewall increasing progressively from base to mouth, the base having a primer pocket and a flash-hole leading through the base from the primer pocket, a primer in the primer pocket, a powder charge in the case forwardly of the base, means comprising a non-obturating type wad for allowing a gradual progressive release of the gas around a wad periphery and into the progressively increasing annular space between wad periphery and sidewall I.D. and interiorly of a nose cap for achieving nose cap blow off in advance of shot charge propulsion, said means comprising an obturating type wad seated in the case forwardly of the powder charge and in embracement with the sidewall I.D., a shot charge forwardly of the wad, and a nose cap forwardly of the shot charge and being seated within the case mouth.

6. The shotshell as set forth in claim 5 including a cylindrical sleeve seated in the case forwardly of the wad and in embracement with the sidewall I.D. and having a forward extremity extending forwardly of the case mouth, with the nose cap encapsulating the outer forward end of the sleeve.

7. The shotshell as set forth in claim 6 with the sleeve having rearwardly extending slits from the forward end thereof.

8. The shotshell as set forth in claim 6 with the wad and sleeve being unitary and with the wad being in embracement with the side wall I.D. and with the sleeve having a cylindrical periphery in embracement with the sidewall I.D. and having a forward extremity extending forwardly of the case mouth.

* * * * *